United States Patent [19]

Jentsch

[11] 4,263,694

[45] Apr. 28, 1981

[54] DOOR CLOSER

[75] Inventor: Dietrich Jentsch, Ennepetal, Fed. Rep. of Germany

[73] Assignee: Dorma-Baubeschlag GmbH & Co. KG, Ennepetal-Voerde, Fed. Rep. of Germany

[21] Appl. No.: 958,988

[22] Filed: Nov. 8, 1978

[30] Foreign Application Priority Data

Nov. 21, 1977 [DE] Fed. Rep. of Germany ..... 2751859

[51] Int. Cl.[3] ..... E05F 15/20; E05F 3/04; E05F 3/10

[52] U.S. Cl. ..... 16/48.5; 16/52; 16/62

[58] Field of Search ..... 16/48.5, 52, 56, 58, 16/62, 69, 64, 79, 82, DIG. 9

[56] References Cited

U.S. PATENT DOCUMENTS

| | | | |
|---|---|---|---|
| 3,852,846 | 12/1974 | Slaybaugh | 16/48.5 |
| 4,050,114 | 9/1977 | Zunkel | 16/48.5 |
| 4,067,084 | 1/1978 | Tillman | 16/82 X |
| 4,115,897 | 9/1978 | Zunkel | 16/62 X |

*Primary Examiner*—Wm. Carter Reynolds
*Attorney, Agent, or Firm*—Michael J. Striker

[57] ABSTRACT

A hydraulically controlled door closer in which a spring cooperating with a piston reciprocatable in a fluid filled bore urges a closer shaft operatively connected to the piston to a position in which a door connected to the closer shaft is closer. The spring is tensioned during turning of the closer shaft in a door opening direction and may be releasably held in the tensioned condition by an additional piston located between one end of the spring and the first-mentioned piston and provided with a first passage therethrough in which a one-way valve is located in a second passage which may be closed and opened by an electromagnetically operated valve.

11 Claims, 8 Drawing Figures

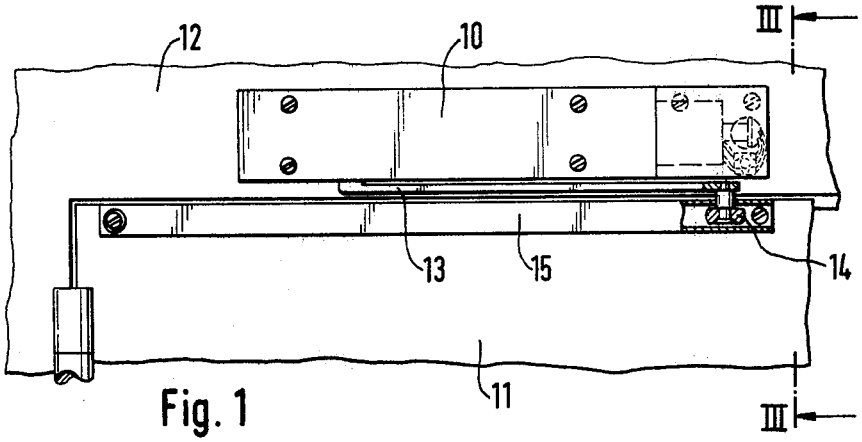
Fig. 1
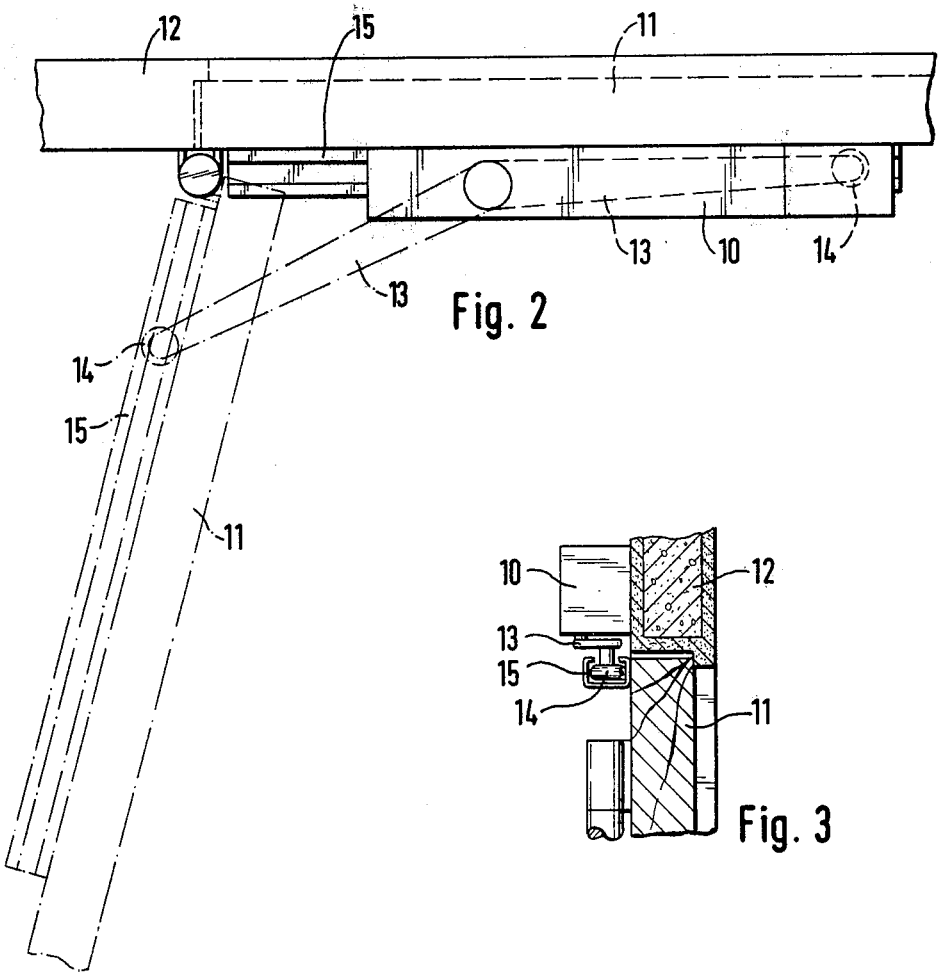
Fig. 2
Fig. 3

DOOR CLOSER

BACKGROUND OF THE INVENTION

The present invention relates to a door closer, especially to a hydraulically controlled door closer with a closer shaft biased by a spring arrangement in door closing position, in which the closer shaft is connected to a piston reciprocable in fluid filled cylinder whereby between the pressure space and the pressureless space in the cylinder a further piston is arranged provided with a one-way valve opening toward the pressure space and an electromagnetically operated valve preventing in the closed position flow of fluid between the two spaces.

The U.S. Pat. No. 3,852,846 discloses a door closer in which two pistons are arranged in a fluid filled cylinder, of which one of the pistons is an operating piston provided with a rack cooperating with a pinion fixed to the closer shaft, whereas the other piston is constructed as a holding piston abutting against the operating piston for holding the latter, by forming a pressure space between the supporting piston and a plug closing one end of the cylinder and provided with an electromagnetically operated valve, in any position when the aforementioned pressure space is closed by the electromagnetically operated valve. In this construction the operating piston is continuously biased in closing direction by a spring arrangement which holds the operating piston in continuous abutment with the supporting piston. The armature of the electromagnetic valve is connected to a valve member which engages in adjacent connecting passages formed in the aforementioned plug and which, depending on the position of the armature, opens, respectively closes, the connecting passages between the pressure space and the pressureless space in which the operating piston is arranged. To prevent pressure build-up in the space in which the operating piston is arranged equalizing channels are provided in the wall of the cylinder in the region of movement of the operating piston, in which throttle valves for damping the closure movement of the door are provided. When the electromagnet is deenergized, the connecting channels between the pressure space behind the supporting piston and the pressureless space in front of the supporting piston are connected to each other and the pressure medium is pressed, during closing of the door by the spring arrangement biasing the operating piston, over the supporting piston abutting against the operating piston from the pressure space into the pressureless space. If the electromagnet is energized, its armature is attracted to close with the valve member connected thereto the connecting conduit so that the supporting piston will hold a door in an open position reached by the door at the moment the electromagnet is energized. The desired opening angle at which the door is to be held in open position may, therefore, be freely selected. A further opening of the door beyond the arrested open position up to its maximal open position is, however, possible against the force of the spring arrangement biasing the operating piston since the equalizing channels in the cylinder wall in the region of movement of the operating piston permit a movement of the latter in opening direction. During opening of the door provided with the above-described door closer it is, therefore, necessary to overcome the force of the spring, tending to move the door to the closed position, and the door will also be moved back from its maximum open position to the predetermined open position when the door is released. The door closing function of the spring can, therefore, not be nullified with this known door closer.

SUMMARY OF THE INVENTION

It is an object of the present invention to provide a door closer of the aforementioned kind which overcomes the disadvantages of such door closers known in the art.

It is a further object of the present invention to provide a door closer of the aforementioned kind in which the spring biasing the closer shaft to the closed position may be held in an inactive tensioned position so that the door connected to the closer shaft may be freely turned by hand in either direction.

It is an additional object of the present invention to provide such a door closer which is composed of a few, relatively simple parts so that the door closer may be produced at relatively little cost.

With these and other objects in view, which will become apparent as the description proceeds, the door closer according to the present invention mainly comprises an elongated housing provided with an axial bore closed at opposite ends and adapted to be filled with fluid, a closer shaft adapted to be connected to the door to be closed by the door closer and mounted in the housing turnable about an axis transverse to the axis of the bore, a piston reciprocably arranged in the bore and operatively connected to the closer shaft so that the latter is turned in closing direction during movement of the piston in one direction in the bore, spring means in the bore arranged to be tensioned during movement of the piston in a direction opposite to the one direction to cooperate, when tensioned, with the piston to move the latter in the one direction and therewith turn the closer shaft in the closing direction, and releasable means cooperating with the spring means forrendering the same in the tension condition inactive so that the piston may freely reciprocate in the bore and the door connected to the closer shaft may be freely turned by hand between an open and a closed position.

The spring means preferably comprise a coil compression spring abutting with one end against one of the closed ends of the bore and the aforementioned releasable means preferably comprise an additional piston reciprocatably arranged in the bore between the other end of the spring and the first-mentioned piston and dividing the bore into two compartments in one of which the aforementioned spring is located. The additional piston is provided with a first passage therethrough in which a one-way valve is arranged permitting flow of fluid from the one into the other compartment during movement of the additional piston in a direction reducing the volume of the one compartment, and the additional piston is provided also with a second passage and means including a second valve movable between an open and a closed position cooperate with the second passage to prevent, in the closed position of the second valve, flow of fluid from the other into the one compartment, while releasable electromagnetic means cooperate with the second valve means for holding the same in the closed position to thereby render the spring means in the tensioned condition inactive.

Such a door closer may be provided on doors which normally are open and closed manually, which, however, in the case of danger, for instance in the case of a fire, should automatically close when the operating person flees from the room and can, therefore, not close the door manually. Such a door closer is therefore advantageously used with a fire-proof door in which it is desirable that it is normally not closed automatically by a compressed spring but can be easily moved by hand between an open and a closed position. It is pointed out that doors with an automatic door closer, which can be opened only by compressing the closer spring to an increasing degree, can only be, especially by children, operated under difficulties, because considerable forces are required to open the door against the force of the increasingly compressed spring. On the other hand, it is important that the fire-proof door is automatically closed in case of a fire.

The first piston is located in the other compartment and preferably provided with a passage therethrough permitting flow of fluid through the first piston during the reciprocation thereof in the bore.

Since during a fire it may happen that the electric circuit connected to the electromagnetically operated second valve is interrupted, it is preferred that the second valve is held in the closed position when the electromagnet is energized and moved to the open position upon deenergizing of the electromagnet. This means, that during interrupting of the circuit leading to the electromagnet, the second valve is immediately opened, permitting thereby flow from the other into the one compartment and concomittant expansion of the compressed coil spring to thereby move the first piston and the closer shaft connected thereto in door closing direction. Of course, it is also possible to interrupt flow of electric current to the electromagnet means by connecting into the circuit of the electromagnet means a fire detector of known construction, which is operated by smoke or temperature increase to interrupt the circuit. It is also possible to arrange a switch in circuit with the electromagnet means permitting at any desired moment to interrupt or to establish the connection to the electromagnet means.

According to a further feature of the present invention the electromagnet means comprise an armature connected to the second valve and adjustable means for limiting the movement of the armature to thereby throttle the closer movement.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a side view of the upper portion of a door above which the door closer according to the present invention is connected to a wall and in which the door closer is connected by a link to a guide rail fixed to the door;

FIG. 2 is a top view of the arrangement shown in FIG. 1;

FIG. 3 is a cross-section taken along the line III—III of FIG. 1;

DESCRIPTION OF THE PREFERRED EMBODIMENTS

Figure 4:
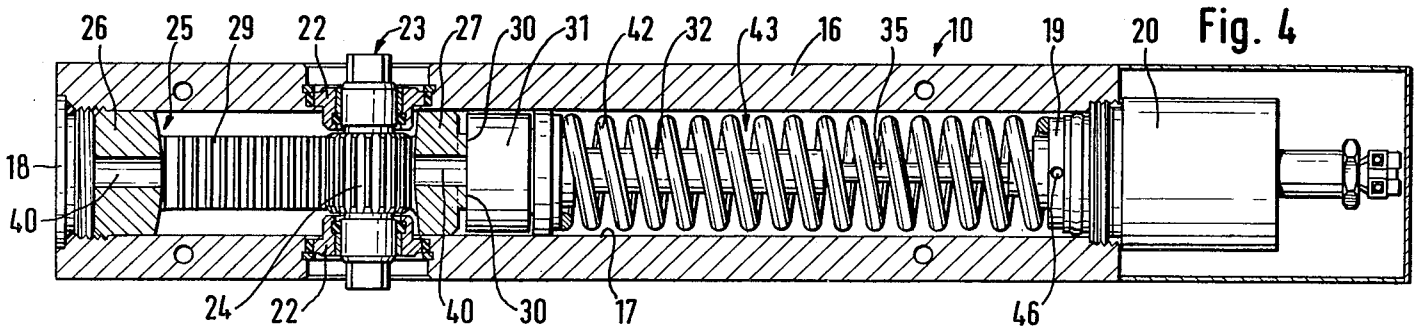
FIG. 4 is a vertical cross-section through the door closer according to the present invention, in which the door closer is shown in the position in which the door is closed.

The door closer 10 shown in FIG. 1 may, for instance, be connected to a wall 12 above a door 11 to engage with a roller 14, turnably mounted on the free end of an arm 13, into a rail 15 of C-shaped cross-section connected in the region of the upper edge of the door to the latter and in which the roller 14 rolls during opening and closing of the door. The door closer 10 according to the present invention may comprise an elongated housing 16 of preferably square cross-section formed with a coaxial cylindrical bore 17 therethrough. As shown in FIGS. 4–8 this bore is fluid tightly closed at its left end, as viewed in these Figures, by a plug 18, whereas a plug 19 is arranged at the right end of the bore. The plug 19 carries an electromagnet 21 surrounded by a sleeve 20. The sleeve 20 is threadingly connected to the right end of the wall of the housing 10 and holds thereby the plug 19 in fixed position in the region of the right end of the housing, as viewed in FIGS. 4–8. A pair of stepped bores aligned along a common axis extending normal to the axis of the bore 17 are provided between the opposite ends of the housing 10 through the walls of the latter, in which bearings 22 are arranged, which in turn mount a closer shaft 23 for turning movement about the bearing axes. The closer shaft 23 carries in the region between the bearings 22 a pinion 24. The bearings 22 are sealed toward the closer shaft 23 as well as toward the housing 16. The closer shaft 23 projects with opposite end portions thereof beyond the outer surfaces of the bearings 22 and these end portions are constructed for receiving the aforementioned lever arm 13 for turning with the closer shaft 23. The arm 13 may, therefore, depending on the mounting of the door closer, be connected to one or the other end of the closer shaft 23.

An operating piston 25, having a first piston head 26 and a second piston head 27 axially spaced from the first piston head and connected to each other by a pair of webs 28 and 29 to opposite sides of the pinion 24, is reciprocatably arranged in the cylinder bore 17. One of the webs, for instance the web 29, is constructed as a rack which meshes with the pinion 24. Turning of the closer shaft 23 will cause, therefore, movement of the operating piston 25 in longitudinal direction. The piston heads 26 and 27 are provided with pressure equalization openings 40 therethrough, which permit free flow of a hydraulic fluid therethrough provided in the bore 17. The piston head 27 has at its right end, as viewed in the drawing, an abutment face 30, against which an end face of an additional piston 31 may abut, which sealingly engages the surface of the bore 17 to divide the latter into two compartments to opposite sides of the additional piston 31. The additional piston 31 is provided with a central extension, projecting in axial direction from that side of the piston 31 which is opposite the aforementioned end face, and an axial bore 33 extends through the piston 31 and the extension 32. The axial bore 33 is provided at its free end with an annular seal 34, which in turn sealingly surrounds a tube 35 connected to the plug 19 and which permits a telescopic movement of the piston extension 32 on the tube 35. The piston 31 is further provided with a stepped bore 36 therethrough providing communication between the aforementioned two compartments. The stepped bore 36 receives a valve member 38, biased by a spring abutting against a sleeve 37 screwed into the wide end of the stepped bore 36, and forming a one-way valve 39 permitting flow of fluid from the compartment to the right side of the additional piston 31 into the other compartment during movement of the additional piston 31 toward the right, as viewed in the drawing, through the clearance between the left end face of the sleeve 37, slightly set back with regard to the left end face of the additional piston 31, and the abutment face 30 of the second piston head 27 while preventing flow of fluid in the opposite direction.

A coil compression spring 42 is arranged in the one compartment to abut with one end against the plug 19 and with the other end against the additional piston 31. The coil spring constitutes a spring arrangement 43 having the function of a power accumulator.

The plug 19 is provided with a central stepped bore 41 therethrough and the above-mentioned tube 35 is fixedly and sealingly connected to the end of the stepped bore 41 which faces the additional piston 31. A valve member 44 is arranged in an enlarged section of the stepped bore 41 and this valve member 44 is fixedly connected to the armature 45 of the above-mentioned electromagnet 21, to be actuated by the latter. A radial bore 46, having one end at the enlarged section of the stepped bore 41 and an opposite end at an outer surface portion of the plug 19 of a diameter smaller than that of the cylinder bore 17, forms together with the stepped bore 41, the tube 35 and the axial bore 33 a further fluid connection between the compartment in which the piston 25 is located and the compartment in which the coil compression spring 42 is located. This connection may be interrupted by a valve 47 constituted by a valve seat formed in the stepped bore 41 and the valve member 44.

A jacket-shaped armature chamber 48, receiving the armature 45 and passing through the magnet spool of the electromagnet 21, is connected to the end of the plug 19 which faces the electromagnet 21. The armature chamber 48 is sealed toward the outside and an axially adjustable bolt 49 is screwed in a sealed manner into the bottom of the valve chamber. The bolt 49 has an abutment face 50 which limits the opening movement of the valve 47 and which can be adjusted in axial direction so that the end of the valve member 44 forms a throttle for the fluid.

Figure 5:
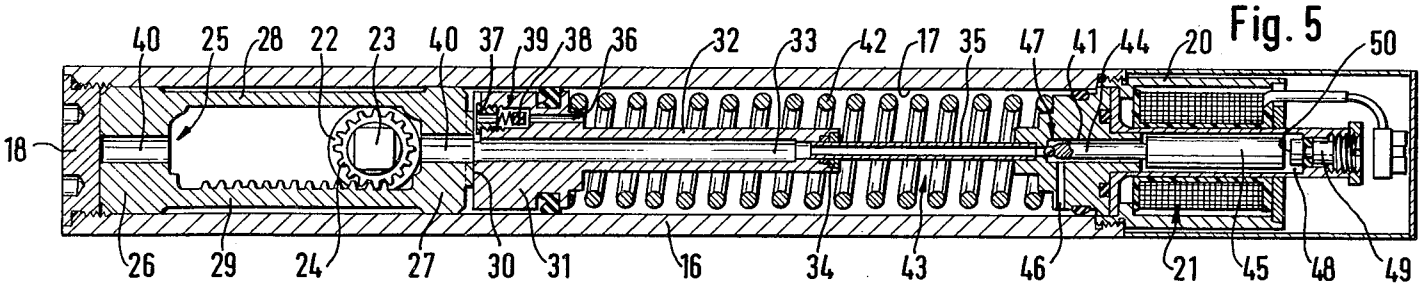
FIG. 5 is a horizontal cross-section through the door closer shown in the position of FIG. 4.
Figure 6:
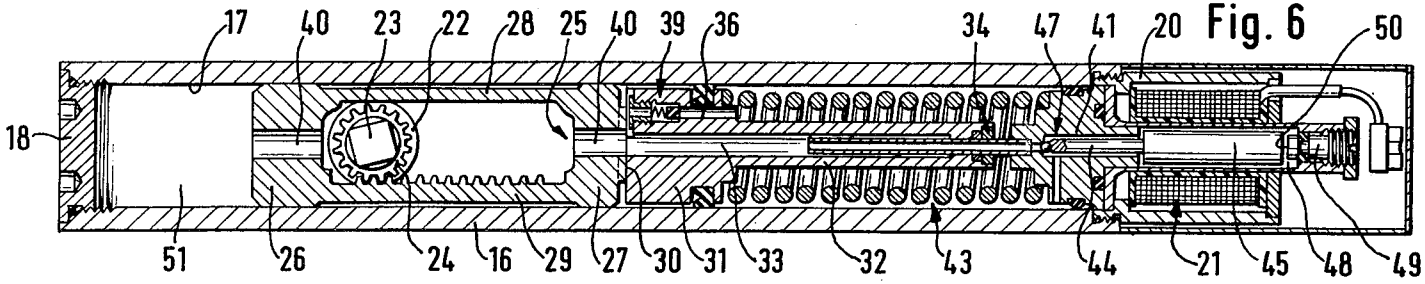
FIG. 6 is a horizontal cross-section through the door closer shown in a position in which the door connected thereto is fully opened.
Figure 7:
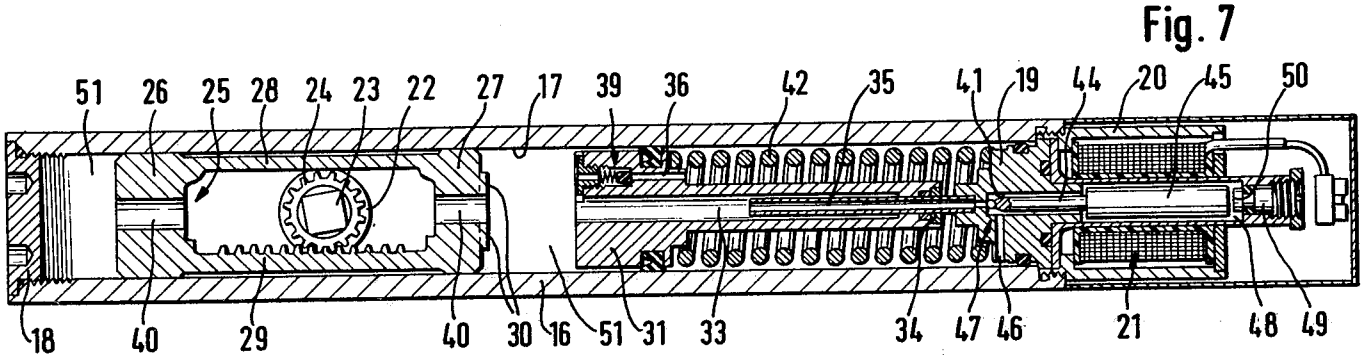
FIG. 7 is a horizontal cross-section through the door closer in which the spring is held in fully compressed condition while the door is partially closed.

The elements of the door closer above described are shown in FIGS. 4 and 5 in a position corresponding to the closed position of the door connected to the door closer. In this position the electromagnet 21 is energized so that the valve member 44 is shown in the position as illustrated in FIGS. 4–7, whereby the valve 47 is closed. If now the door 11 is manually moved in opening direction, then the pinion 24, connected to the closer shaft 23 for turning movement therewith, will move the operating piston 25 toward the right, as viewed in the drawing to press thereby also the additional piston 31 against the force of the coil compression spring 42 towards the right. The coil compression spring is thereby stressed, i.e. compressed, to an increasing degree and simultaneously the pressure of the fluid in the cylinder compartment in which the coil compression spring 42 is arranged is increased so that the one-way valve 39 opens, as shown in FIG. 5, and so that pressure fluid during continuous opening movement of the door will be displaced from the compartment or cylinder space to the right side of the additional piston 31 into the compartment or cylinder space to the left side thereof. This procedure is illustrated in FIG. 6 and it can be continued until the maximum opening angle of the door is reached. In the illustrated embodiment of the door closer the rack on the web 29 is so long and the compression stroke of the coil compression spring 42 so large that a door opening angle of about 180° may be reached. During movement of the additional piston 31 to a position corresponding to the desired opening angle of the door fluid will flow through the one-way valve 39 from the compartment to the right of the piston 31, while the valve 47 is closed, into the cylinder compartment 51 in which the operating piston 25 is arranged (FIGS. 6, 7) and the spring 42 will be compressed. After compression of the spring 42, pressure will build up in the compartment 51 when the operator releases the door and while the valve 47 remains closed, which pressure corresponds to the force produced by the compressed coil spring 42 divided by the surface of the end face of the additional piston 31. This higher pressure in the compartment 51 closes the one-way valve 39 so that during turning of the door back to the closed position, the additional piston 31 will, due to the overpressure in the compartment 51, remain in the position it is moved during opening of the door. The additional piston 31 constitutes, therefore, releasable arresting means for holding the coil compression spring in the compressed condition to which it is moved during turning of the door in opening direction. Since the operating piston 25 is provided with the aforementioned pressure equalization openings 40 it can be reciprocated over the pinion 24 connected to the closer shaft 23 freely and without expenditure of force during the opening and closing movement of the door in the compartment 51 within the first adjusted door opening angle. In the arrested position of the additional piston 31 the action of the door closer with respect to its closing function is, therefore, cancelled.

Figure 8:
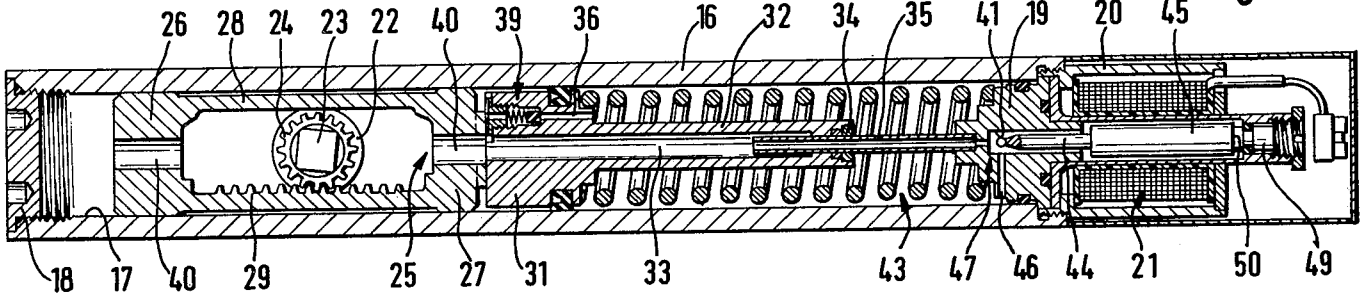
FIG. 8 is a horizontal cross-section through the door closer in which the spring is released to thereby move the door connected to the door closer to the closed position.

If now for any reason whatsoever the electromagnet 21 is deenergized, then the valve member 44 and the armature 45 is pressed by the fluid pressure acting on the valve member 44 to the open position, as shown in FIG. 8, so that fluid may flow from the compartment 51 through the axial bore 33, the tube 35, the stepped bore 41, the radial bore 46 into the compartment in which the coil spring 42 is arranged, to thereby equalize the fluid pressure in the two cylinder compartments in front and behind the additional piston 31. The additional piston 31 is thereby moved by the tensioned coil compression spring 42 towards the left, as viewed in FIG. 8, and presses also the operating piston 25 towards the left, so that the closer shaft 23 is turned in door closing direction, whereby the door closer again carries out its actual function. The electromagnet 21 constitutes, therefore, means for releasing the arrested piston 31. The releasable arresting means, i.e. the piston 31 and the electromagnet 21 are arranged coaxially with coil spring 42.

Such a door closer is advantageously used in all cases in which for instance during a fire the closer function is desired, whereas the closer function normally during continuous operation of the door should be eliminated.

It will be understood that each of the elements described above, or two or more together, may also find a useful application in other types of door closers differing from the types described above.

While the invention has been illustrated and described as embodied in a door closer in which the closing action thereof may be selectively initiated or eliminated, it is not intended to be limited to the details shown, since various modifications and structural changes may be made without departing in any way from the spirit of the present invention.

Thus, it is for instance possible to reverse the function of the closer valve 47 so that the latter remains closed when the electromagnet 21 is deenergized and opens when the electromagnet is energized, so that instead of the above-described closed circuit current principle an open circuit principle is used. It is also possible to deenergize, respectively energize, the electromagnet 21 in different ways, for instance by a manually operatable switch, a monitoring member, as for instance a fire detector, or similar means.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a door closer, a combination comprising a closer shaft adapted to be connected to a door to be closed and being turnable about its axis between a first position in which a door connected thereto is closed and a second position in which the door is opened; spring means arranged for biasing said closer shaft to said first position, said spring means having a fixed first end and a second end movable from a first to a second position in which said spring means is further stressed than in said first position; means between said closer shaft and said second end of said spring means for moving the latter to said second position; releasable arresting means for holding said second end of said spring means in said second position to thus prevent said spring means from biasing said closer shaft to said first position so that said closer shaft is freely turnable between said positions thereof; and means for releasing said arresting means so that said second end of said spring means may move from said second to said first position to thereby bias said closer shaft to said first position thereof, said releasable arresting means and said means for releasing said arresting means being arranged coaxially with said spring means.

2. A combination as defined in claim 1, wherein said releasing means comprises electromagnetic means movable between an arresting position and a releasing position releasing said arresting means.

3. A combination as defined in claim 2, and including an elongated housing provided with an axial bore closed at opposite ends and adapted to be filled with a hydraulic fluid, said closer shaft being mounted on said housing with its axis extending transverse to that of said bore, said spring means comprising a coil compression spring arranged in said bore with said first end thereof abutting against one of said closed ends, said means between said closer shaft and said second end of said spring means comprising an operating piston reciprocatably arranged in said bore and operatively connected to said closer shaft to be moved in one direction during turning of said closer shaft from said first to said second position; said releasable arresting means comprising an additional piston arranged in said bore between said operating piston and said second end of said spring and dividing the bore in two compartments, in one of which said spring is located, a first passage through said additional piston, a one-way valve in said first passage permitting flow of fluid from said one into the other compartment during movement of said additional piston in a direction reducing the volume of said one compartment, a second passage through said additional piston, and means including a second valve movable between an open and a closed position and cooperating with the second passage to prevent in said closed position flow of fluid from the other into said one compartment; said electromagnet means of said releasing means being arranged for controlling the position of said second valve.

4. A combination as defined in claim 3, wherein said operating piston is located in the other of said compartments.

5. A combination as defined in claim 4, wherein said operating piston is provided with a passage therethrough permitting flow of fluid through said operating piston during reciprocation thereof in said bore.

6. A combination as defined in claim 4, wherein said operating piston comprises a pair of axially spaced interconnected piston heads each provided with a passage therethrough permitting flow of fluid therethrough during reciprocation of said operating piston in said bore.

7. A combination as defined in claim 6, wherein the passages through the piston heads are axially aligned with each other.

8. A combination as defined in claim 6, wherein said piston heads are connected to each other by a rack and wherein said closer shaft fixedly carries a pinion meshing with said rack.

9. A combination as defined in claim 3, wherein said second valve is held in said closed position when said electromagnet means is energized, said second valve moving to the open position upon deenergizing of said electromagnet means.

10. A combination as defined in claim 3, wherein said electromagnet means comprises an armature connected to said second valve and adjustable means for limiting the stroke of the armature.

11. A combination as defined in claim 3, wherein said means preventing flow of fluid from said other into said one compartment further comprises stationary tubular means coaxial with said second passage and connected at one end to said one closed end of said bore and forming a valve seat at said one end, said tubular means telescopically extending in a sealed manner with the other end thereof into said second passage and said second valve engaging in said closed position thereof said valve seat.

* * * * *